US011211739B2

(12) United States Patent
Gu

(10) Patent No.: US 11,211,739 B2
(45) Date of Patent: Dec. 28, 2021

(54) WATERPROOF REVERSIBLE USB RECEPTACLE AND METHOD FOR MANUFACTURING THE SAME

(71) Applicant: SHENZHEN EVERWIN PRECISION TECHNOLOGY CO LTD, Guangdong (CN)

(72) Inventor: Yuanwen Gu, Guangdong (CN)

(73) Assignee: SHENZHEN EVERWIN PRECISION TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/760,261

(22) PCT Filed: Jun. 28, 2019

(86) PCT No.: PCT/CN2019/093535
§ 371 (c)(1),
(2) Date: Apr. 29, 2020

(87) PCT Pub. No.: WO2020/024739
PCT Pub. Date: Feb. 6, 2020

(65) Prior Publication Data

US 2021/0111508 A1 Apr. 15, 2021

(30) Foreign Application Priority Data

Aug. 3, 2018 (CN) ..... 201810877492.0

(51) Int. Cl.
*H01R 13/52* (2006.01)
*H01R 13/502* (2006.01)
(Continued)

(52) U.S. Cl.
CPC ..... *H01R 13/5202* (2013.01); *H01R 13/502* (2013.01); *H01R 43/005* (2013.01);
(Continued)

(58) Field of Classification Search
CPC .. H01R 13/52; H01R 13/5202; H01R 13/502; H01R 13/6581; H01R 43/005; H01R 43/18; H01R 43/20
See application file for complete search history.

(56) References Cited

U.S. PATENT DOCUMENTS 9,627,796 B2 * 4/2017 Tsai ..... H01R 13/5202
9,634,425 B1 4/2017 Hsu et al.
(Continued)

FOREIGN PATENT DOCUMENTS

CN 105390877 A 3/2016
CN 107069309 A 8/2017
(Continued)

OTHER PUBLICATIONS

International Search Report and Written Opinion in International Application No. PCT/CN2019/093535 (dated Aug. 30, 2019).

*Primary Examiner* — Oscar C Jimenez
(74) *Attorney, Agent, or Firm* — W&G Law Group

(57) ABSTRACT

A waterproof reversible USB receptacle and a method for manufacturing the waterproof reversible USB receptacle, including: an insulation case having a hollow portion; a stopper integrally formed in the hollow portion of the insulation case and including a blocking body, a through hole formed in the blocking body, and extension sheets formed by extending from the blocking body while being bent, the extension sheets being integrally formed in the insulation case; a connector sleeved in the insulation case and including a base portion stopped on the blocking body, and a connection tongue portion extending forward from the base portion and passing through the through hole of the stopper; and a waterproof adhesive coated on a rear portion of the insulation case. The extension sheets further extend to
(Continued)

form fixing plates bent to be buckled to a rear end of the base portion after the connector is inserted.

24 Claims, 7 Drawing Sheets

(51) Int. Cl.
*H01R 43/00* (2006.01)
*H01R 43/18* (2006.01)
*H01R 43/20* (2006.01)
*H01R 13/6581* (2011.01)

(52) U.S. Cl.
CPC ..... *H01R 43/18* (2013.01); *H01R 43/20* (2013.01); *H01R 13/6581* (2013.01)

(56) References Cited

U.S. PATENT DOCUMENTS

| | | | | |
|---|---|---|---|---|
| 10,276,971 | B2 * | 4/2019 | Zhao | H01R 13/5219 |
| 10,483,696 | B2 * | 11/2019 | Zhao | H01R 13/502 |
| 2013/0183844 | A1 * | 7/2013 | Wang | H01R 24/68 439/271 |
| 2016/0294105 | A1 * | 10/2016 | Zhao | H01R 12/724 |
| 2016/0329667 | A1 * | 11/2016 | Tsai | H01R 13/5216 |
| 2018/0294599 | A1 * | 10/2018 | Ono | H01R 13/521 |

FOREIGN PATENT DOCUMENTS

| | | | |
|---|---|---|---|
| CN | 206585131 | U | 10/2017 |
| CN | 107799962 | A | 3/2018 |
| CN | 109004420 | A | 12/2018 |
| CN | 109088215 | A | 12/2018 |
| CN | 109088227 | A | 12/2018 |

* cited by examiner

WATERPROOF REVERSIBLE USB RECEPTACLE AND METHOD FOR MANUFACTURING THE SAME

CROSS-REFERENCE TO RELATED APPLICATIONS

This patent application is the U.S. national phase of International Application No. PCT/CN2019/093535, filed on Jun. 28, 2019, which claims priority to Chinese Patent Application No. 201810877492.0, filed on Aug. 3, 2018. The disclosures of the aforementioned applications are hereby incorporated by reference in their entireties.

TECHNICAL FIELD

The present disclosure relates to the field of connectors, and in particular, to a waterproof reversible USB receptacle and a method for manufacturing the same.

BACKGROUND

The existing reversible USB receptacle generally includes a connector and a metal case sleeved on a periphery of the connector. With commercialization of 5G, the metal case contacts a metal middle frame of a mobile phone, and the metal middle frame is a mobile phone antenna. As a result, an electrical contact between the metal case and the metal middle frame affects signals of the mobile phone antenna.

In view of the above reasons or other factors, it is necessary to provide a reversible USB receptacle using an insulation case.

SUMMARY

In view of this, it is necessary to provide a waterproof reversible USB receptacle having an insulation case.

In order to solve the technical problem described above, the present disclosure provides a waterproof reversible USB receptacle, including: a stopper integrally formed in the hollow portion of the insulation case, wherein the stopper comprises a blocking body, a through hole formed in the blocking body, and extension sheets formed by extending from upper and lower sides of the blocking body while being bent, the extension sheets being integrally formed in the insulation case; a connector sleeved in the insulation case and comprising a base portion and a connection tongue portion extending forward from the base portion, wherein the connection tongue portion passes through the through hole of the stopper, the base portion is stopped on the blocking body, the extension sheets further extend to form fixing plates, and the fixing plates are bent to be buckled to a rear end surface of the base portion after the connector is inserted into the insulation case; and a waterproof adhesive coated on a rear portion of the insulation case.

The waterproof reversible USB receptacle provided by the present disclosure is provided with the insulation case, and the stopper is integrally formed in the hollow portion of the insulation case. The fixing plate is provided on the extension sheet of the stopper, and after the connector is inserted into the insulation case, the fixing plate is bent and buckled to the connector, so as to ensure retention force of the insulation case on the connector, meanwhile the metal case is removed to avoid interference on a signal of a mobile phone antenna.

Preferably, the connector further comprises a middle plate, first and second terminal sets located at upper and lower sides of the middle plate, and an insulation body that forms the middle plate, the first and second terminal sets into one piece.

Preferably, the insulation body comprises the base portion, the connection tongue portion, and a fixing block formed at a rear end of the base portion and isolated from the base portion, wherein an isolation area without plastic is formed between the fixing block and the base portion, and the fixing block and the base portion are connected as one piece by the first and second terminal sets.

Preferably, the first and second terminal sets include contact portions exposed on upper and lower surfaces of the connection tongue portion, a holding portion formed in the insulation body and partially exposed in the isolation area, and a weld leg extending beyond a lower surface of the fixing block.

Preferably, first buckle structures are provided on upper and lower surfaces of the base portion, and second buckle structures are provided at positions of the hollow portion of the insulation case corresponding to the first buckle structures; the first buckle structures and the second buckle structures are buckle blocks or buckle slots, and the buckle slots of the second buckle structures are located at inner sides of the fixing plates of the stopper and correspond to the buckle blocks of the first buckle structures.

Preferably, a middle portion of the blocking body of the stopper is removed to form a positioning notch, and a positioning protrusion matching the positioning notch is provided at a front end surface of the base portion of the insulation body.

Preferably, after the connector is inserted into the insulation case, a periphery of the isolation area corresponds to an inner wall of the hollow portion, and the waterproof adhesive is coated in the isolation area and tightly bound to the inner wall of the hollow portion.

Preferably, the insulation case further comprises a peripheral wall and an installation portion formed at a front end of the peripheral wall, and an outer diameter of the installation portion is larger than an outer diameter of the peripheral wall; a ring-shaped installing groove is formed at a front end surface of the installation portion, and a waterproof ring is to be installed in the ring-shaped installing groove.

Preferably, the waterproof ring comprises a front end portion and an insertion portion extending backward from the front end portion and inserted into the ring-shaped installing groove; a thickness of the insertion portion is smaller than a thickness of the front end portion, and the front end portion of the waterproof ring is located on the front end surface of the installation portion for pressing against an inner wall of a case or other components of a mobile phone to achieve waterproofing.

Preferably, the USB receptacle further includes a shielding part buckled to the fixing block of the insulation body.

In order to solve the technical problem described above, the present disclosure further provides a method for manufacturing a waterproof reversible USB receptacle, including: a step S01 of forming a stopper by punching, and injection molding the stopper integrally to form an insulation case, wherein the stopper comprises a blocking body, a through hole formed in the blocking body, and extension sheets formed by extending from upper and lower sides of the blocking body while being bent, the extension sheets are formed in the insulation case, and the extension sheets are further provided with fixing plates connected to a material strip; a step S02 of providing a formed connector, and inserting the connector into the insulation case, wherein the connector comprises a base portion and a connection tongue portion extending forward from the base portion, the connection tongue portion passes through the through hole of the stopper, and the base portion is stopped at a rear end of the blocking body of the stopper; and a step S03 of bending the fixing plates of the stopper inwards to be buckled to a rear end surface of the base portion of the insulation body.

Preferably, the connector further comprises a middle plate, first and second terminal sets located at upper and lower sides of the middle plate, and an insulation body that forms the middle plate and the first and second terminal sets into one piece, wherein the insulation body comprises the base portion, the connection tongue portion, and a fixing block formed at a rear end of the base portion and isolated from the base portion, an isolation area without plastic is formed between the fixing block and the base portion, and the fixing block and the base portion are connected as one piece by the first and second terminal sets.

Preferably, after the step S03, the method further includes a step S04 of coating a waterproof adhesive in the isolation area of the insulation body, the waterproof adhesive being filled in the isolation area and limited by an inner wall of the insulation case.

Preferably, a filling area is formed between the isolation area and the inner wall of the insulation case, and the waterproof adhesive is tightly bound to an inner wall of a hollow portion of the insulation case to achieve waterproofing.

In order to solve the technical problem described above, the present disclosure further provides a waterproof reversible USB receptacle, including: an insulation case having a hollow portion; a stopper integrally formed in the hollow portion of the insulation case; a connector sleeved in the insulation case and fixed by the stopper; and a waterproof adhesive coated on a rear portion of the insulation case, wherein the connector comprises a middle plate, first and second terminal sets located at upper and lower sides of the middle plate, and an insulation body that forms the middle plate and the first and second terminal sets into one piece, wherein the insulation body comprises a base portion, a connection tongue portion extending forward from the base portion, and a fixing block formed at a rear end of the base portion and isolated from the base portion, and wherein the first and second terminal sets comprise contact portions exposed beyond upper and lower surfaces of the connection tongue portion, holding portions extending backward from the contact portions and formed in the base portion and the fixing block, and a weld leg extending to a lower surface of the fixing block; and a shielding part is buckled to a top surface of the fixing block.

Preferably, the fixing block comprises a body portion extending laterally, buckle holes provided at two lateral ends of the body portion, and buckle protrusions provided at two lateral side surfaces of the body portion; the shielding part comprises a shielding body covering the fixing block, two side walls formed by extending from two lateral sides of the shielding body while being bent, and a rear wall formed by extending from a rear end of the shielding body while being bent; and the shielding part completely shields and covers the fixing block and a part of the first and second terminal sets in the fixing block by the shielding body, the two side walls and the rear wall.

Preferably, the stopper comprises a blocking body, a through hole formed in the blocking body, and extension sheets formed by extending from upper and lower sides of the blocking body while being bent; the extension sheets are integrally formed in the insulation case, the connection tongue portion passes through the through hole of the stopper, and the base portion is stopped on the blocking body; the extension sheets further extend to form fixing plates, and after the connector is inserted, the fixing plates are bent to be buckled to a rear end surface of the base portion.

Preferably, an isolation area without plastic is formed between the fixing block and the base portion, and the fixing block and the base portion are connected into one piece by the first and second terminal sets.

Preferably, first buckle structures are provided at upper and lower surfaces of the base portion, and second buckle structures are provided at positions of the hollow portion of the insulation case corresponding to the first buckle structures, wherein the first buckle structures and the second buckle structures are buckle blocks or buckle slots, and the buckle slots of the second buckle structures are located at inner sides of the fixing plates of the stopper and correspond to the buckle blocks of the first buckle structures.

Preferably, a middle portion of the blocking body of the stopper is removed to form a positioning notch, and a positioning protrusion matching the positioning notch is provided at a front end surface of the base portion of the insulation body.

Preferably, after the connector is inserted into the insulation case, a periphery of the isolation area corresponds to an inner wall of the hollow portion, and the waterproof adhesive is coated in the isolation area and tightly bound to the inner wall of the hollow portion.

Preferably, the insulation case further comprises a peripheral wall and an installation portion formed at a front end of the peripheral wall, and an outer diameter of the installation portion is larger than an outer diameter of the peripheral wall a ring-shaped installing groove is formed at a front end surface of the installation portion, a waterproof ring is to be installed in the ring-shaped installing groove, and the waterproof ring comprises a front end portion and an insertion portion extending backward from the front end portion and inserted into the ring-shaped installing groove; a thickness of the insertion portion is smaller than a thickness of the front end portion, and the front end portion of the waterproof ring is located on the front end surface of the installation portion for pressing against an inner wall of a case or other components of a mobile phone to achieve waterproofing.

In order to solve the technical problem described above, the present disclosure further provides a waterproof reversible USB receptacle, including: an insulation case having a hollow portion; a stopper assembled in the hollow portion of the insulation case; a connector sleeved in the insulation case; and a waterproof adhesive coated on a rear portion of the insulation case, wherein the stopper comprises a blocking body, a through hole formed in the blocking body, and at least two pairs of fixing plates formed by extending from upper and lower sides of the blocking body while being bent; a step portion and a buckle slot provided at a rear end of the step portion are provided in the hollow portion of the insulation case, the stopper is encapsulated into the hollow portion from a front end of the insulation case, the blocking body abuts against the step portion, and at least one pair of the at least two pairs of fixing plates are bent outwards and buckled into the buckle slot to be fixed; the connector comprises a base portion and a connection tongue portion extending forward from the base portion, the connection tongue portion passes through the through hole of the stopper from a rear end of the insulation case, the base portion is stopped on the step portion, and at least one pair of the at least two pairs of fixing plates are bent inwards and buckled to a rear end surface of the base portion to fix the connector.

Preferably, the connector further comprises a middle plate, first and second terminal sets located at upper and lower sides of the middle plate, and an insulation body that forms the middle plate and the first and second terminal sets into one piece, wherein the insulation body comprises the base portion, the connection tongue portion, and a fixing block formed at a rear end of the base portion and isolated from the base portion, wherein an isolation area without plastic is formed between the fixing block and the base portion, and the fixing block and the base portion are connected into one piece by the first and second terminal sets.

Preferably, first buckle structures are provided at upper and lower surfaces of the base portion, and second buckle structures are provided at positions of the hollow portion of the insulation case corresponding to the first buckle structures; the first buckle structures and the second buckle structures are buckle blocks or buckle slots, and the buckle slots of the second buckle structures are located at inner sides of the fixing plates of the stopper and correspond to the buckle blocks of the first buckle structures.

Preferably, a middle portion of the blocking body of the stopper is removed to form a positioning notch, and a positioning protrusion matching the positioning notch is provided at a front end surface of the base portion of the insulation body.

Preferably, after the connector is inserted into the insulation case, a periphery of the isolation area corresponds to an inner wall of the hollow portion, and the waterproof adhesive is coated in the isolation area and tightly bound to the inner wall of the hollow portion.

Preferably, the insulation case further comprises a peripheral wall and an installation portion formed at a front end of the peripheral wall, an outer diameter of the installation portion is larger than an outer diameter of the peripheral wall, a ring-shaped installing groove is formed at a front end surface of the installation portion, and a waterproof ring is to be installed in the ring-shaped installing groove.

Preferably, the waterproof ring comprises a front end portion and an insertion portion extending backward from the front end portion and inserted into the ring-shaped installing groove, wherein a thickness of the insertion portion is smaller than a thickness of the front end portion, and the front end portion of the waterproof ring is located at the front end surface of the installation portion for pressing against an inner wall of a case or other components of a mobile phone to achieve waterproofing.

BRIEF DESCRIPTION OF DRAWINGS

The accompanying drawings herein are used to provide a further illustration of the present disclosure and constitute a part of the present disclosure. The schematic embodiments of the present disclosure and the descriptions thereof are used to illustrate the present disclosure and do not constitute an improper limitation on the present disclosure. In the drawings.

DESCRIPTION OF EMBODIMENTS

In order to make the purpose, technical solutions, and advantages of the present disclosure clearer, the technical solutions of the present disclosure will be clearly and fully described below with reference to exemplary embodiments of the present disclosure and the corresponding accompanying drawings. It should be noted that the described embodiments are merely a part of embodiments of the present disclosure, rather than all of the embodiments. All other embodiments obtained by those skilled in the art without creative efforts according to the embodiments of the present disclosure shall fall within the scope of the present disclosure.

Referring to FIG. 1 to FIG. 5, the waterproof reversible USB receptacle provided by the present disclosure includes a connector A, an insulation case 20 sleeved on a periphery of the connector A, a stopper 60 that is integrally formed inside the insulation case 20 and fixes the connector A, a shielding part 40 covering a rear portion of the connector A, and a waterproof adhesive 50 coated between the connector A and the insulation case 20.

Figure 3:
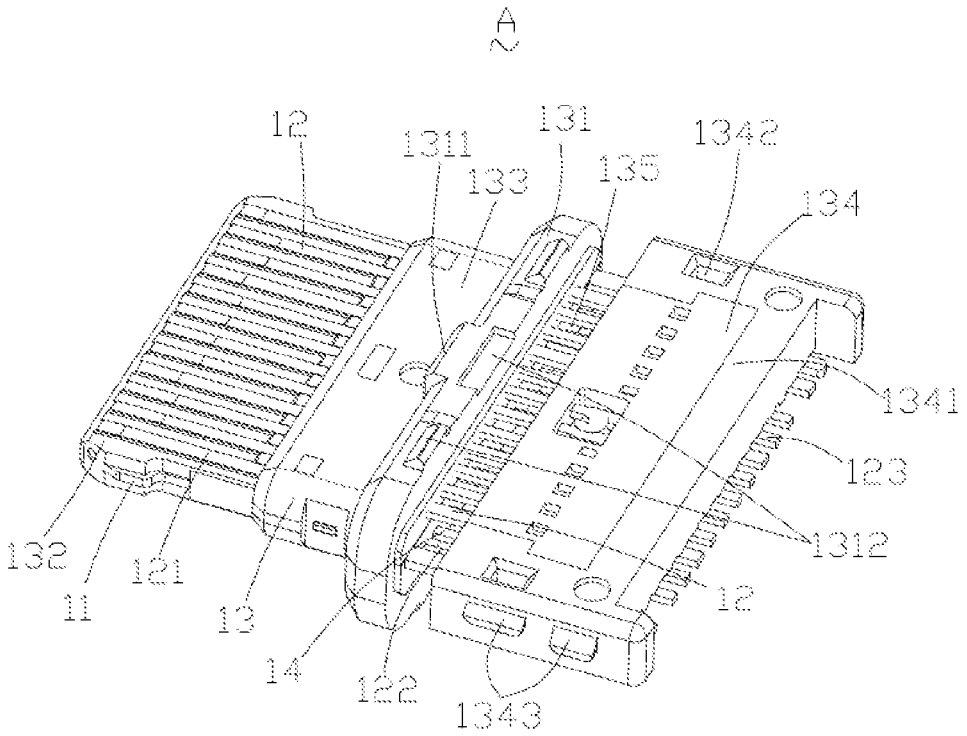
FIG. 3 is a perspective view of a connector of a waterproof reversible USB receptacle according to the present disclosure.

With reference to FIG. 3, the connector A includes a middle plate 11, first and second terminal sets 12, 14 disposed at upper and lower sides of the middle plate 11, and an insulation body 13 that forms the middle plate 11 and the first and second terminal sets 12, 14 into one piece.

The insulation body 13 includes a base portion 131, a connection tongue portion 132 extending forward from the base portion 131, a forming covering portion 133 disposed between the base portion 131 and the connection tongue portion 132, and a fixing block 134 formed at rear portions of the first and second terminal sets 12, 14. The base portion 131 and the fixing block 134 are independent from each other and an isolation area 135 is formed between the base portion 131 and the fixing block 134. The first and second terminal sets 12, 14 are each provided with a contact portion 121 exposed beyond upper and lower surfaces of the connection tongue portion 132, a holding portion 122 formed in the insulation body 13 and partially exposed in the isolation area 135, and a weld leg 123 extending beyond a bottom surface of the fixing block 134.

An outer diameter of the base portion 131 is larger than an outer diameter of the forming covering portion 133. A positioning protrusion 1311 is formed at a front end of the base portion 131 facing the connection tongue portion 132. Further, several first buckle structures 1312 are provided at upper and lower end surfaces of the base portion 131. The first buckle structure 1312 is a buckle slot or a buckle block. The waterproof adhesive 50 is coated in the isolation area 135.

The fixing block 134 includes a body portion 1341 extending laterally, buckle holes 1342 provided at two lateral ends of the body portion 1341, and buckle protrusions 1343 provided on two lateral side surfaces of the body portion 1341.

The insulation body 13 includes an insulator formed by injection molding multiple times. For example, the first terminal set 12 and the middle plate 11 are injection molded integrally to form a first insulator, the second terminal set 13 is injection molded integrally to form a second insulator, and the first and second insulators are combined and injection molded to form a third insulator.

Figure 6:
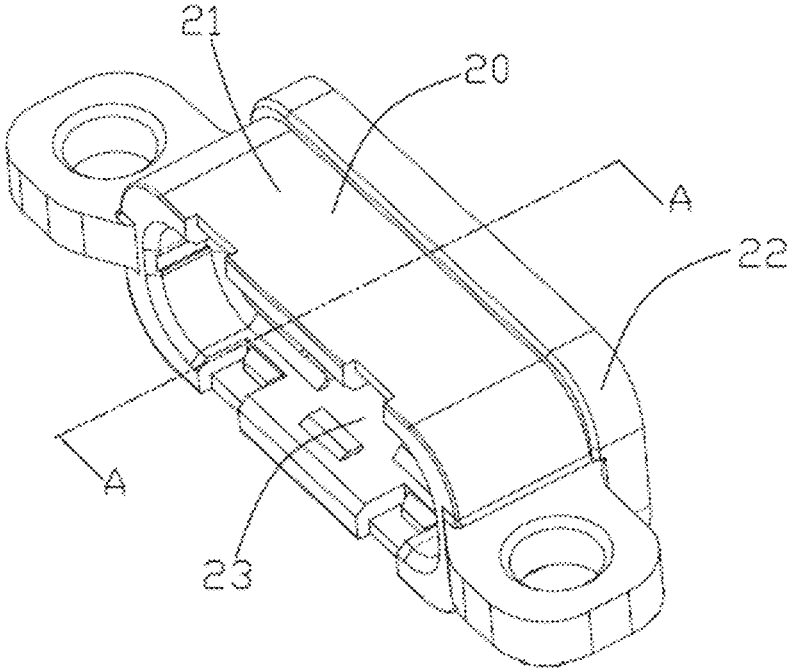
FIG. 6 is a perspective view of an insulation case of a waterproof reversible USB receptacle according to the present disclosure.
Figure 7:
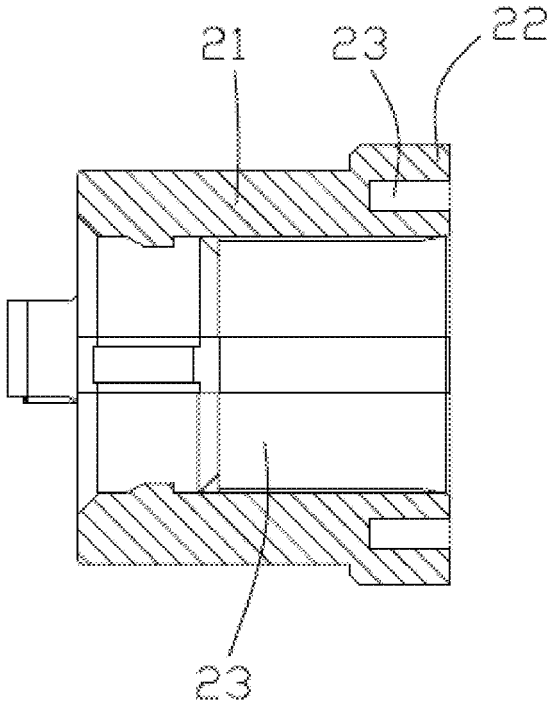
FIG. 7 is a cross sectional view along a dashed line A-A shown in FIG. 6.
Figure 8:
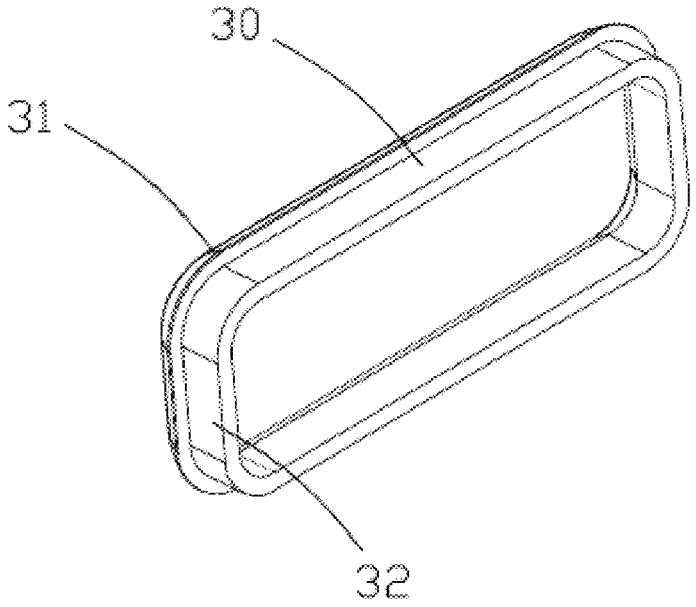
FIG. 8 is a perspective view of a waterproof ring of a waterproof reversible USB receptacle according to the present disclosure.
Figure 11:
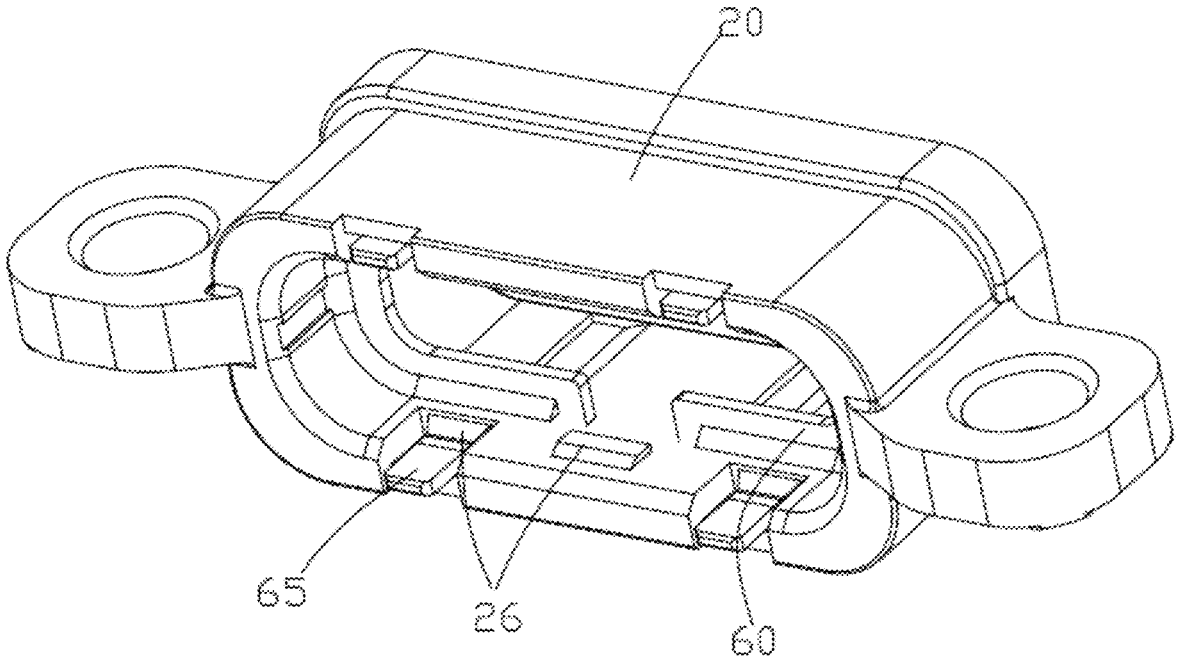
FIG. 11 is a perspective view of a waterproof reversible USB receptacle with an insulation case being integrally formed with a stopper according to the present disclosure.

Referring to FIG. 6, FIG. 7, and FIG. 8, the insulation case 20 includes a peripheral wall 21, a hollow portion 23 defined by the peripheral wall 21, and an installation portion 22 formed at a front end of the peripheral wall 21. An outer diameter of the installation portion 22 is larger than an outer diameter of the peripheral wall 21. A ring-shaped installing groove 25 for installing a waterproof ring 30 is provided at a front end surface of the installation portion 22. Several second buckle structures 26 (see FIG. 11) that match the first buckle structures 1312 of the insulation body 13 are provided at a rear end of the hollow portion 23.

The waterproof ring 30 includes a front end portion 31 and an insertion portion 32 that extends backward from the front end portion 31 and is inserted into the ring-shaped installing groove 25. A thickness of the insertion portion 32 is smaller than a thickness of the front end portion 31. The front end portion of the waterproof ring 30 is disposed on the front end surface of the installation portion 22 and presses against an inner wall of a case of a mobile phone or other components so as to achieve waterproofing.

Figure 9:
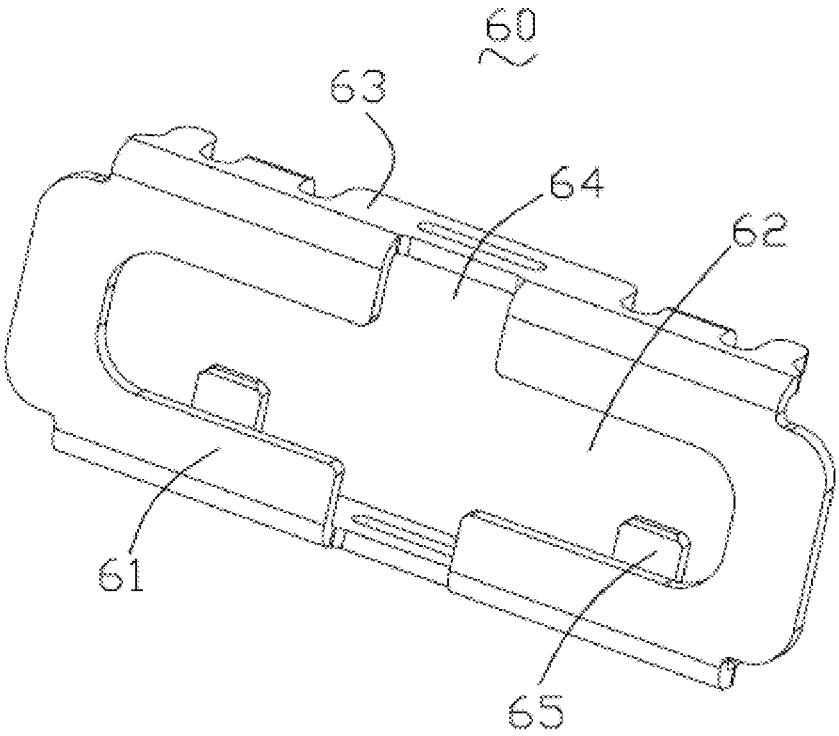
FIG. 9 is a perspective view of a stopper of a waterproof reversible USB receptacle according to the present disclosure.
Figure 10:
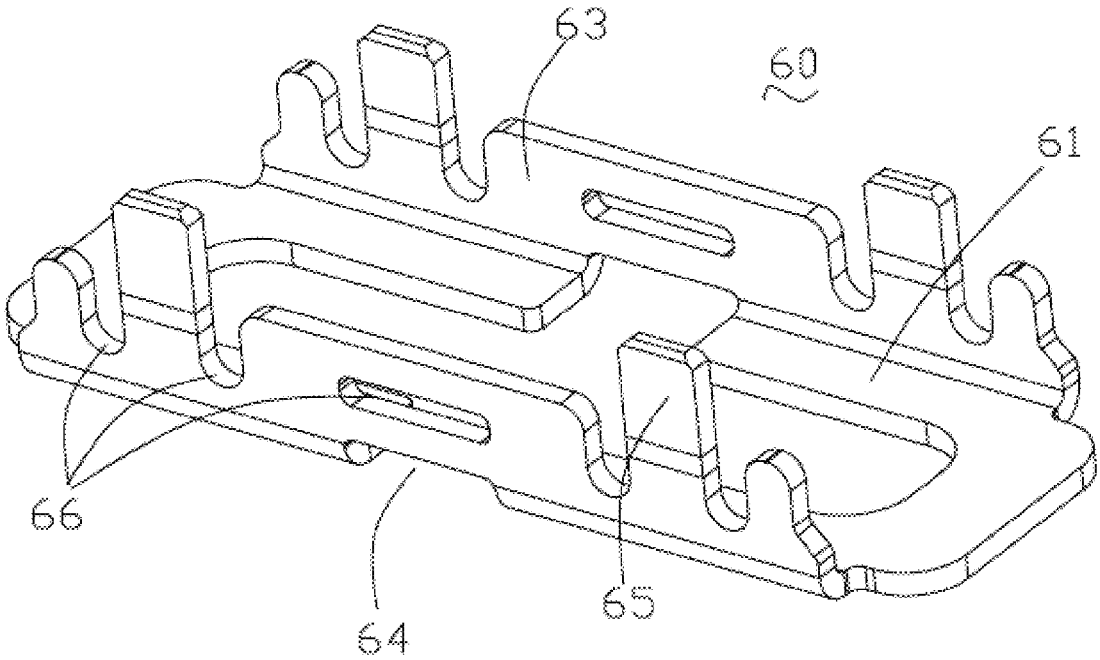
FIG. 10 is a perspective view of a stopper of a waterproof reversible USB receptacle in another visual angle according to the present disclosure.
Figure 12:
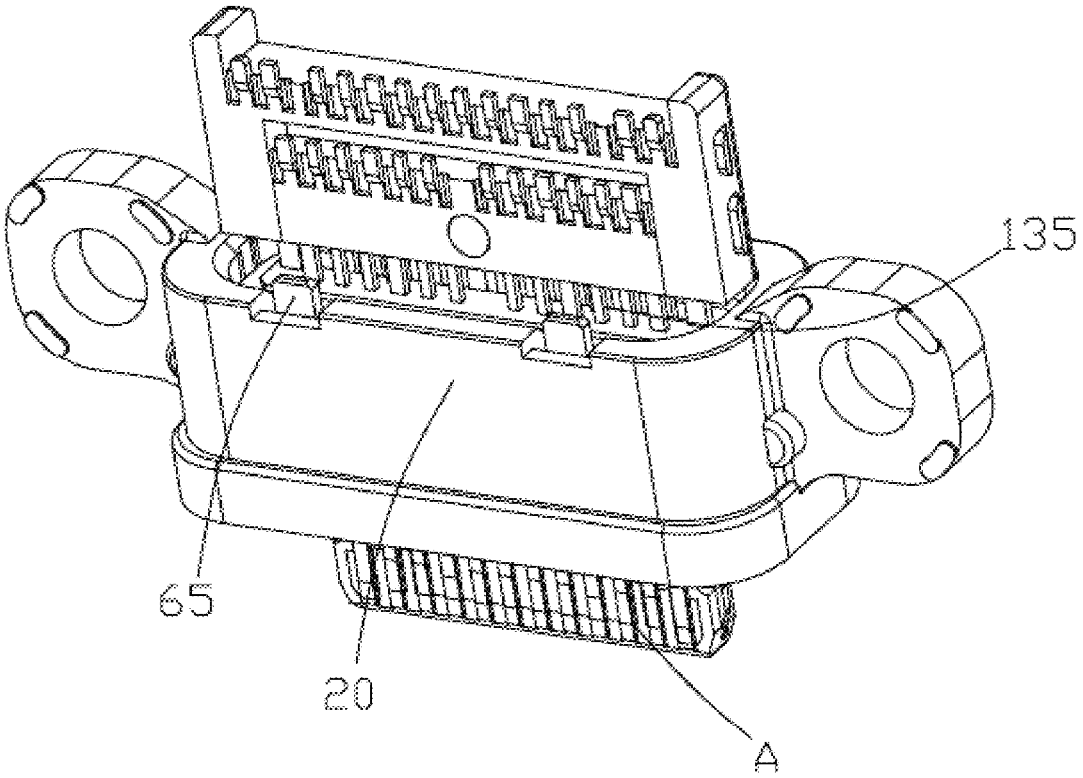
FIG. 12 is a perspective view of a waterproof reversible USB receptacle with a connector being assembled into an insulation case according to the present disclosure.
Figure 13:
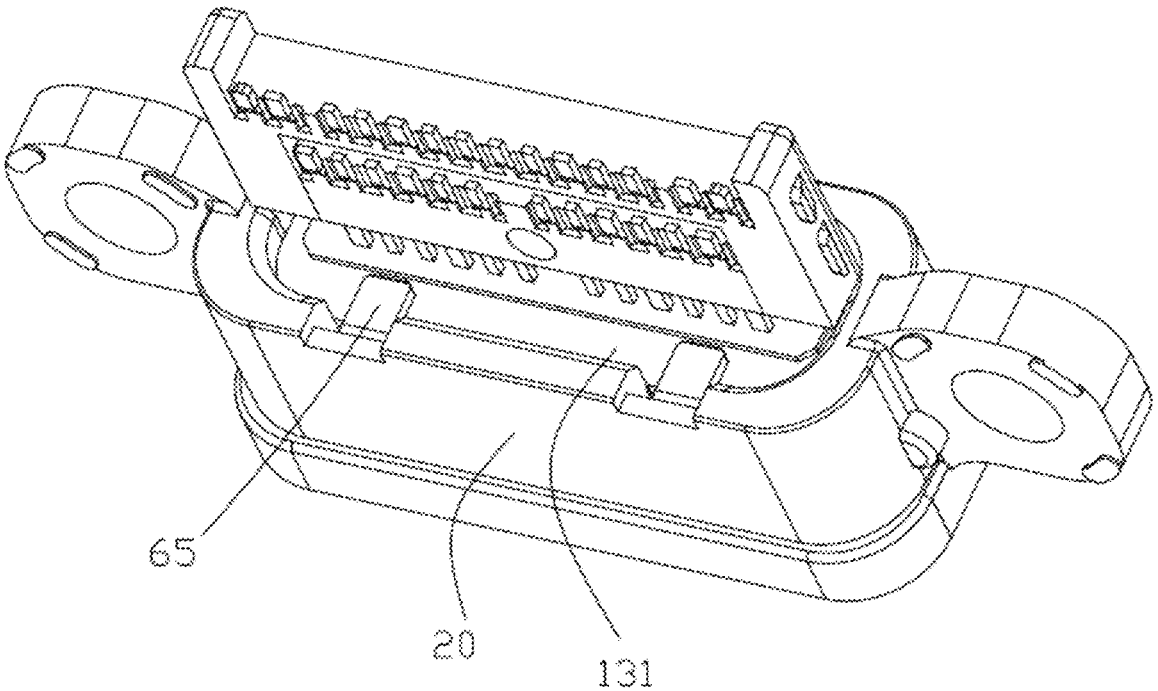
FIG. 13 is a perspective view of a waterproof reversible USB receptacle with a buckle of a stopper being bent and buckled to a connector according to the present disclosure.

Referring to FIG. 9 and FIG. 10, the stopper 60 includes a blocking body 61, a through hole 62 formed in the blocking body 61 for the connection tongue portion 132 and the forming covering portion 133 to pass through, and extension sheets 63 that are formed by extending from upper and lower sides of the blocking body 61 while being bent vertically. The extension sheets 63 are integrally formed in an inner wall of the hollow portion 23 of the insulation case 20. The extension sheet 63 is provided with several hole or groove structures 66 for filling plastics to enhance a binding force between the stopper 60 and the insulation case 20. The extension sheet 63 is further provided with a fixing plate 65, and the fixing plate 65 is bent and buckled to a rear end surface of the base portion 131 of the insulation body 13 of the connector A after the connector A is inserted into the insulation case 20, so as to fix the connector A (as shown in FIG. 12 and FIG. 13). A middle portion of the blocking body 61 of the stopper 60 is cut to form a positioning notch 64, and the positioning protrusion 1311 on the front end of the base portion 131 of the insulation body 13 fits in the positioning notch 64.

A position of the buckle slot of the second buckle structure 26 of the insulation case 20 coincides with a position of the fixing plate 65, and the buckle slot is located at an inner side the fixing plate 65. The buckle block of the first buckle structure 1312 of the base portion 131 of the insulation body 13 corresponds to and matches the buckle slot of the second buckle structure 26. The buckle block of the first buckle structure 1312 supports the bending of the fixing plate 65 and bears the force.

Figure 1:
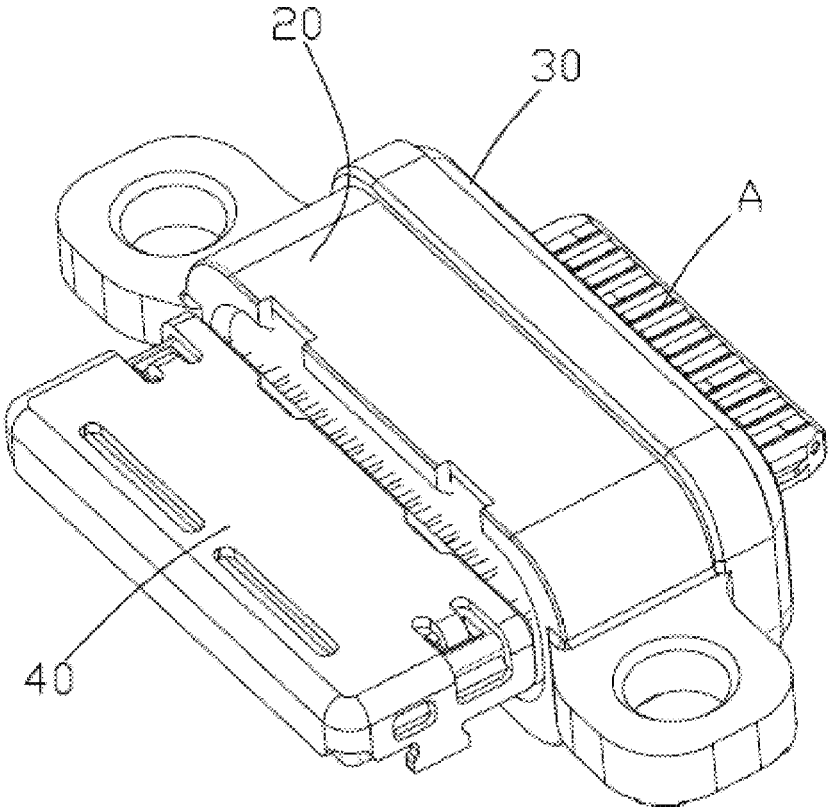
FIG. 1 is a perspective assembly view of a waterproof reversible USB receptacle according to the present disclosure.
Figure 2:
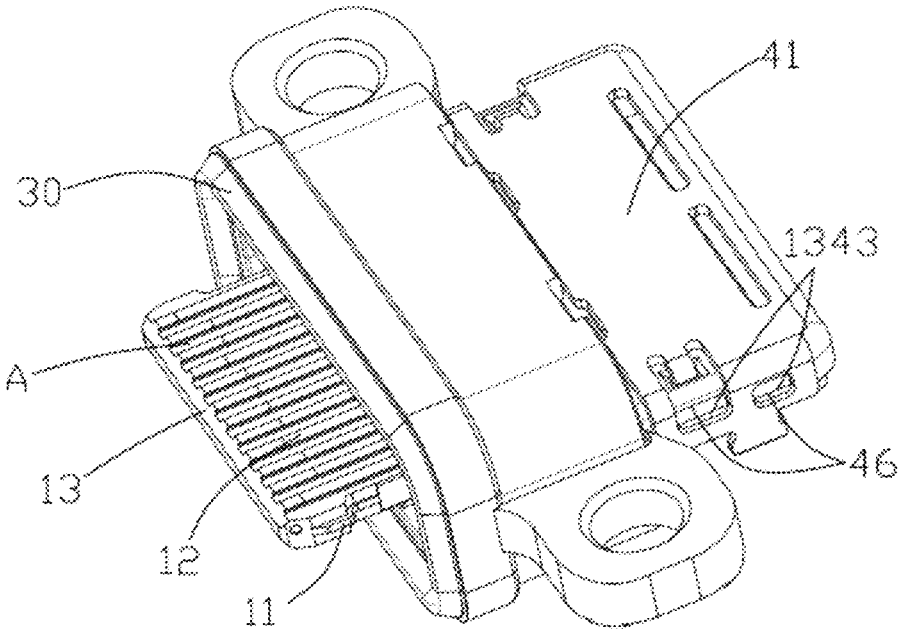
FIG. 2 is a perspective assembly view of a waterproof reversible USB receptacle in another visual angle according to the present disclosure.
Figure 4:
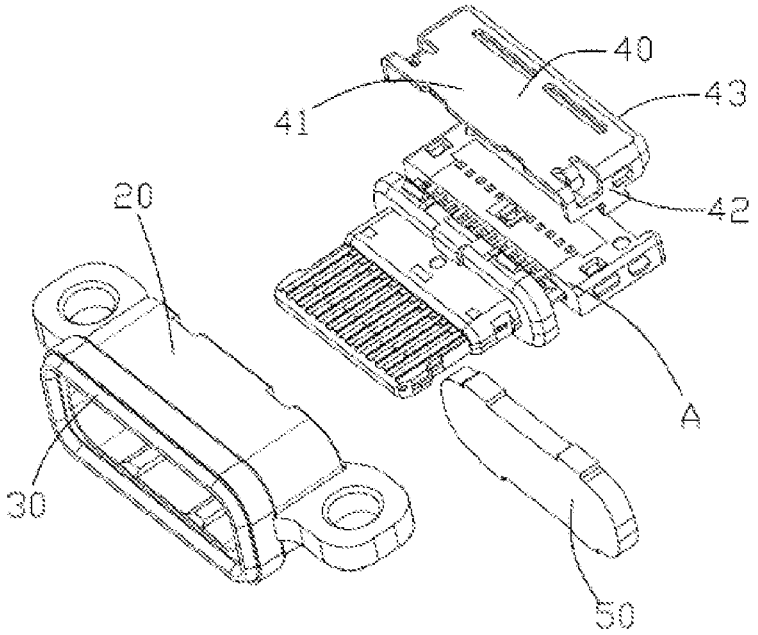
FIG. 4 is a perspective exploded view of a waterproof reversible USB receptacle according to the present disclosure.
Figure 5:
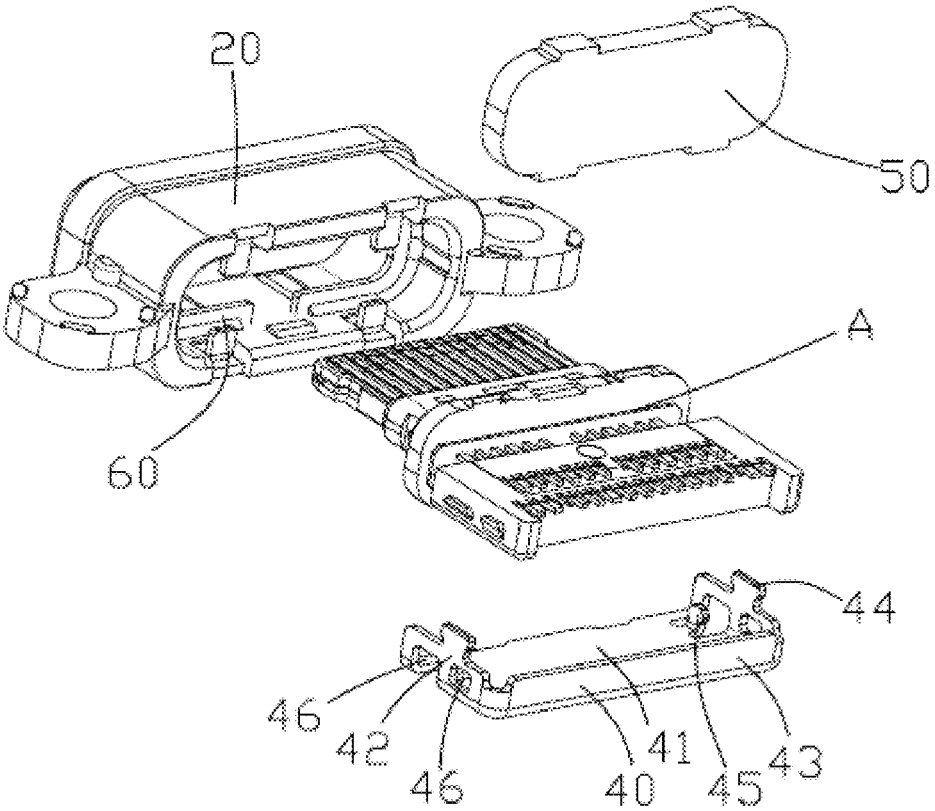
FIG. 5 is a perspective exploded view of a waterproof reversible USB receptacle in another visual angle according to the present disclosure

Referring to FIG. 1, FIG. 4 and FIG. 5, the shielding part 40 includes a shielding body 41 covering the fixing block 134, two side walls 42 formed by extending from two lateral sides of the shielding body 41 while being bent, and a rear wall 43 formed by extending from a rear end of the shielding body 41 while being bent. The shielding part 40 completely shields and covers the fixing block 134 and partial first and second terminal sets 12, 14 inside the fixing block 134 with the shielding body 41, the two side walls 42 and the rear wall 43.

Buckle holes 46 are formed in the two side walls 42 to be buckled to the buckle protrusions 1343 of the fixing block 134. The shielding body 41 is torn at positions corresponding to the buckle holes 1342 of the fixing block 134 to form buckle hooks 45 inserted into the buckle holes 1342. The two side walls 42 further include welding portions 44 extending downward and welded to a printed circuit board.

Please refer to FIG. 1 to FIG. 13. A method for manufacturing the waterproof reversible receptacle of the present disclosure will be described below in detail, and the method includes steps S01 to S05.

At step S01, a stopper 60 is formed by punching, and the stopper 60 is injection molded integrally to form the insulation case 20.

At this time, the fixing plate 65 of the stopper 60 is parallel to the extension sheet 63 without bending, the fixing plate 65 is connected to a material strip (not shown), and the material strip extends out of the insulation case 20.

At step S02, a formed connector A is provided, and a connection tongue portion 132 side of the connector A is inserted into the insulation case 20.

At this time, the connection tongue portion 132 and the forming covering portion 133 of the connector A pass through the through hole 62 of the stopper 60, the base portion 131 is stopped at a rear end of the blocking body 61 of the stopper 60, and a front end of the blocking body 61 is used to prevent over-insertion of connector.

At step S03, the fixing plate 65 of the stopper 60 is bent inward and buckled to a rear end surface of the base portion 131 of the insulation body 13.

At this time, the blocking body 61 of the stopper 60 and the extension sheet 65 clamp and fix the base portion 131 from front and rear sides of the base portion 131.

At step S04, a waterproof adhesive 50 is coated in the isolation area 135 of the insulation body 13, and the waterproof adhesive 50 is filled between the inner wall of the insulation case 20 and the isolation area 135.

A filling area is formed between the isolation area 135 and the inner wall of the insulation case 20. The waterproof adhesive 50 only needs to be tightly bound to the inner wall of the hollow portion 23 of the insulation case 20 to achieve waterproofing. The isolation area 135 prevents a gap from being formed between the inner wall of the insulation case 20 and the insulation body 13 to cause incomplete filling and water leakage.

At step S05, the shielding part 40 is inserted into the fixing block 134 of the insulation body 13.

In another embodiment, the stopper 60 is not integrally formed with the insulation case 20, instead, a step portion is provided at the hollow portion 23 of the insulation case 20, and a groove structure is provided at a rear end of the step portion. The stopper is sleeved in the hollow portion 23 from a front end of the hollow portion 23 to abut against the step portion, and then the fixing plate 65 is bent to be buckled to the groove structure at the rear end of the step portion. Finally, the connector A is inserted in the insulation case 20 from the rear end of the insulation case 20, and an additional fixing plate is provided on the stopper 60 to be bent to hold the connector A.

It should be noted that, in the present disclosure, terms "including", "comprising" or any other variants thereof are intended to represent non-exclusive inclusion. Therefore, a process, method, item or device including a series of elements includes not only those elements, but also other elements not explicitly listed, or elements inherent to such a process, method, item or device. Without more restrictions, an element limited by an expression "including a/an/one . . . " does not mean that there are no other identical elements in this process, method, item, or device that includes this element.

The above-described embodiments are merely exemplary embodiments of the present disclosure and are not intended to limit the present disclosure. Various modifications and changes may be made by those skilled in the art, however, any modifications, equivalent substitutions and improvements made within the principle of the present disclosure shall fall into the protection scope of the present disclosure.

What is claimed is:

1. A waterproof reversible USB receptacle, comprising:

an insulation case having a hollow portion;

a stopper integrally formed in the hollow portion of the insulation case, wherein the stopper comprises a blocking body, a through hole formed in the blocking body, and extension sheets formed by extending from the blocking body while being bent, the extension sheets being integrally formed in the insulation case;

a connector sleeved in the insulation case and comprising a base portion and a connection tongue portion extending forward from the base portion, wherein the connection tongue portion passes through the through hole of the stopper, the base portion is stopped on the blocking body, the extension sheets further extend to form fixing plates, and the fixing plates are bent to be buckled to a rear end of the base portion after the connector is inserted into the insulation case; and a waterproof adhesive coated on a rear portion of the insulation case.

2. The waterproof reversible USB receptacle according to claim 1, wherein the connector further comprises a middle plate, first and second terminal sets located at upper and lower sides of the middle plate, and an insulation body that forms the middle plate, the first and second terminal sets into one piece.

3. The waterproof reversible USB receptacle according to claim 2, wherein the insulation body comprises the base portion, the connection tongue portion, and a fixing block formed at a rear end of the base portion and isolated from the base portion, wherein an isolation area without plastic is formed between the fixing block and the base portion, and the fixing block and the base portion are connected as one piece by the first and second terminal sets.

4. The waterproof reversible USB receptacle according to claim 3, wherein first buckle structures are provided on upper and lower surfaces of the base portion, second buckle structures are provided at positions of the hollow portion of the insulation case corresponding to the first buckle structures, the first buckle structures and the second buckle structures are buckle blocks or buckle slots, and the buckle slots of the second buckle structures are located at inner sides of the fixing plates of the stopper and correspond to the buckle blocks of the first buckle structures.

5. The waterproof reversible USB receptacle according to claim 3, wherein after the connector is inserted into the insulation case, a periphery of the isolation area corresponds to an inner wall of the hollow portion, and the waterproof adhesive is coated in the isolation area and tightly bound to the inner wall of the hollow portion.

6. The waterproof reversible USB receptacle according to claim 1, wherein the insulation case further comprises a peripheral wall and an installation portion formed at a front end of the peripheral wall, an outer diameter of the installation portion is larger than an outer diameter of the peripheral wall, a ring-shaped installing groove is formed at a front end surface of the installation portion, and a waterproof ring is to be installed in the ring-shaped installing groove.

7. The waterproof reversible USB receptacle according to claim 6, wherein the waterproof ring comprises a front end portion and an insertion portion extending backward from the front end portion and inserted into the ring-shaped installing groove, wherein a thickness of the insertion portion is smaller than a thickness of the front end portion, the front end portion of the waterproof ring is located on the front end surface of the installation portion for pressing against an inner wall of a case or other components of a mobile phone to achieve waterproofing.

8. A method for manufacturing a waterproof reversible USB receptacle, comprising:

forming a stopper by punching, and injection molding the stopper integrally to form an insulation case, wherein the stopper comprises a blocking body, a through hole formed in the blocking body, and extension sheets formed by extending from upper and lower sides of the blocking body while being bent, the extension sheets are formed in the insulation case, and the extension sheets are further provided with fixing plates connected to a material strip;

providing a formed connector, and inserting the connector into the insulation case, wherein the connector comprises a base portion and a connection tongue portion extending forward from the base portion, the connection tongue portion passes through the through hole of the stopper, and the base portion is stopped at a rear end of the blocking body of the stopper; and bending the fixing plates of the stopper inwards to be buckled to a rear end surface of the base portion of the insulation body.

9. The method for manufacturing the waterproof reversible USB receptacle according to claim 8, wherein the connector further comprises a middle plate, first and second terminal sets located at upper and lower sides of the middle plate, and an insulation body that forms the middle plate and the first and second terminal sets into one piece, wherein the insulation body comprises the base portion, the connection tongue portion, and a fixing block formed at a rear end of the base portion and isolated from the base portion, an isolation area without plastic is formed between the fixing block and the base portion, and the fixing block and the base portion are connected as one piece by the first and second terminal sets, wherein the method further comprises, after the bending the fixing plates of the stopper inwards to be buckled to a rear end surface of the base portion of the insulation body:

coating a waterproof adhesive in the isolation area of the insulation body, the waterproof adhesive being filled in the isolation area and limited by an inner wall of the insulation case.

10. The method for manufacturing the waterproof reversible USB receptacle according to claim 9, wherein a filling area is formed between the isolation area and the inner wall of the insulation case, and the waterproof adhesive is tightly bound to an inner wall of a hollow portion of the insulation case to achieve waterproofing.

11. A waterproof reversible USB receptacle, comprising:

an insulation case having a hollow portion;

a stopper integrally formed in the hollow portion of the insulation case;

a connector sleeved in the insulation case and fixed by the stopper; and a waterproof adhesive coated on a rear portion of the insulation case, wherein the connector comprises a middle plate, first and second terminal sets located at upper and lower sides of the middle plate, and an insulation body that forms the middle plate and the first and second terminal sets into one piece, wherein the insulation body comprises a base portion, a connection tongue portion extending forward from the base portion, and a fixing block formed at a rear end of the base portion and isolated from the base portion, wherein the first and second terminal sets comprise contact portions exposed beyond upper and lower surfaces of the connection tongue portion, holding portions extending backward from the contact portions and formed in the base portion and the fixing block, and a weld leg extending to a lower surface of the fixing block, wherein the waterproof reversible USB receptacle further comprises a shielding part buckled to a top surface of the fixing block, wherein the stopper comprises a blocking body, a through hole formed in the blocking body, and extension sheets formed by extending from upper and lower sides of the blocking body while being bent, wherein the extension sheets are integrally formed in the insulation case, the connection tongue portion passes through the through hole of the stopper, and the base portion is stopped on the blocking body, and wherein the extension sheets further extend to form fixing plates, and after the connector is inserted, the fixing plates are bent to be buckled to a rear end surface of the base portion.

12. The waterproof reversible USB receptacle according to claim 11, wherein the fixing block comprises a body portion extending laterally, buckle holes provided at two lateral ends of the body portion, and buckle protrusions provided at two lateral side surfaces of the body portion;

wherein the shielding part comprises a shielding body covering the fixing block, two side walls formed by extending from two lateral sides of the shielding body while being bent, and a rear wall formed by extending from a rear end of the shielding body while being bent; and wherein the shielding part completely shields and covers the fixing block and a part of the first and second terminal sets in the fixing block by the shielding body, the two side walls and the rear wall.

13. The waterproof reversible USB receptacle according to claim 11, wherein an isolation area without plastic is formed between the fixing block and the base portion, and the fixing block and the base portion are connected into one piece by the first and second terminal sets.

14. The waterproof reversible USB receptacle according to claim 13, wherein after the connector is inserted into the insulation case, a periphery of the isolation area corresponds to an inner wall of the hollow portion, and the waterproof adhesive is coated in the isolation area and tightly bound to the inner wall of the hollow portion.

15. The waterproof reversible USB receptacle according to claim 11, wherein first buckle structures are provided at upper and lower surfaces of the base portion, and second buckle structures are provided at positions of the hollow portion of the insulation case corresponding to the first buckle structures, wherein the first buckle structures and the second buckle structures are buckle blocks or buckle slots, and the buckle slots of the second buckle structures are located at inner sides of the fixing plates of the stopper and correspond to the buckle blocks of the first buckle structures.

16. The waterproof reversible USB receptacle according to claim 11, wherein a middle portion of the blocking body of the stopper is removed to form a positioning notch, and a positioning protrusion matching the positioning notch is provided at a front end surface of the base portion of the insulation body.

17. The waterproof reversible USB receptacle according to claim 11, wherein the insulation case further comprises a peripheral wall and an installation portion formed at a front end of the peripheral wall, and an outer diameter of the installation portion is larger than an outer diameter of the peripheral wall;

wherein a ring-shaped installing groove is formed at a front end surface of the installation portion, a waterproof ring is to be installed in the ring-shaped installing groove, and the waterproof ring comprises a front end portion and an insertion portion extending backward from the front end portion and inserted into the ring-shaped installing groove; and wherein a thickness of the insertion portion is smaller than a thickness of the front end portion, and the front end portion of the waterproof ring is located on the front end surface of the installation portion for pressing against an inner wall of a case or other components of a mobile phone to achieve waterproofing.

18. A waterproof reversible USB receptacle, comprising:

an insulation case having a hollow portion;

a stopper assembled in the hollow portion of the insulation case;

a connector sleeved in the insulation case; and a waterproof adhesive coated on a rear portion of the insulation case, wherein the stopper comprises a blocking body, a through hole formed in the blocking body, and at least two pairs of fixing plates formed by extending from upper and lower sides of the blocking body while being bent;

wherein the waterproof reversible USB receptacle further comprises a step portion and a buckle slot provided at a rear end of the step portion, the step portion and the buckle slot provided at the rear end of the step portion are provided in the hollow portion of the insulation case, the stopper is encapsulated into the hollow portion from a front end of the insulation case, the blocking body abuts against the step portion, and at least one pair of the at least two pairs of fixing plates are bent outwards and buckled into the buckle slot to be fixed; and wherein the connector comprises a base portion and a connection tongue portion extending forward from the base portion, the connection tongue portion passes through the through hole of the stopper from a rear end of the insulation case, the base portion is stopped on the step portion, and at least one pair of the at least two pairs of fixing plates are bent inwards and buckled to a rear end surface of the base portion to fix the connector.

19. The waterproof reversible USB receptacle according to claim 18, wherein the connector further comprises a middle plate, first and second terminal sets located at upper and lower sides of the middle plate, and an insulation body that forms the middle plate and the first and second terminal sets into one piece, wherein the insulation body comprises the base portion, the connection tongue portion, and a fixing block formed at a rear end of the base portion and isolated from the base portion, wherein an isolation area without plastic is formed between the fixing block and the base portion, and the fixing block and the base portion are connected into one piece by the first and second terminal sets.

20. The waterproof reversible USB receptacle according to claim 19, wherein first buckle structures are provided at upper and lower surfaces of the base portion, and second buckle structures are provided at positions of the hollow portion of the insulation case corresponding to the first buckle structures; and wherein the first buckle structures and the second buckle structures are buckle blocks or buckle slots, and the buckle slots of the second buckle structures are located at inner sides of the fixing plates of the stopper and correspond to the buckle blocks of the first buckle structures.

21. The waterproof reversible USB receptacle according to claim 19, wherein a middle portion of the blocking body of the stopper is removed to form a positioning notch, and a positioning protrusion matching the positioning notch is provided at a front end surface of the base portion of the insulation body.

22. The waterproof reversible USB receptacle according to claim 19, wherein after the connector is inserted into the insulation case, a periphery of the isolation area corresponds to an inner wall of the hollow portion, and the waterproof adhesive is coated in the isolation area and tightly bound to the inner wall of the hollow portion.

23. The waterproof reversible USB receptacle according to claim 18, wherein the insulation case further comprises a peripheral wall and an installation portion formed at a front end of the peripheral wall, an outer diameter of the installation portion is larger than an outer diameter of the peripheral wall, a ring-shaped installing groove is formed at a front end surface of the installation portion, and a waterproof ring is to be installed in the ring-shaped installing groove.

24. The waterproof reversible USB receptacle according to claim 23, wherein the waterproof ring comprises a front end portion and an insertion portion extending backward from the front end portion and inserted into the ring-shaped installing groove, wherein a thickness of the insertion portion is smaller than a thickness of the front end portion, and the front end portion of the waterproof ring is located at the front end surface of the installation portion for pressing against an inner wall of a case or other components of a mobile phone to achieve waterproofing.

* * * * *